US006200676B1

(12) United States Patent
Matsubara et al.

(10) Patent No.: US 6,200,676 B1
(45) **Date of Patent: *Mar. 13, 2001**

(54) INK JET RECORDING MEDIUM

(75) Inventors: Miyuki Matsubara, Tokyo; Tokuya Ohta, Yokohama; Masahiro Chiba, Machida; Tomomi Kaneko, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/079,726

(22) Filed: Jun. 22, 1993

(30) Foreign Application Priority Data

Jul. 31, 1992 (JP) ..... 4-204914

(51) Int. Cl.[7] ..... B41M 5/00
(52) U.S. Cl. ..... 428/341; 428/195; 428/342
(58) Field of Search ..... 428/195, 500, 428/537.5, 522, 534, 536, 341, 342

(56) References Cited

U.S. PATENT DOCUMENTS

| | | | | |
|---|---|---|---|---|
| 4,517,244 | | 5/1985 | Kobayashi et al. | 428/342 |
| 5,139,868 | * | 8/1992 | Mori et al. | 428/327 |
| 5,185,213 | * | 2/1993 | Fujita et al. | 428/500 |
| 5,518,821 | * | 5/1996 | Sakaki et al. | 428/500 |
| 5,570,120 | * | 10/1996 | Sakaki et al. | 347/105 |

FOREIGN PATENT DOCUMENTS

| | | | |
|---|---|---|---|
| 54-59936 | | 5/1979 | (JP) . |
| 58-160316 | * | 9/1983 | (JP) . |
| 2-137764 | * | 5/1990 | (JP) . |
| 3-13993 | | 2/1991 | (JP) . |
| 3-25352 | | 4/1991 | (JP) . |
| 3-26665 | | 4/1991 | (JP) . |
| 3-29596 | | 4/1991 | (JP) . |

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is a recording medium comprising a base material, the surface of which is coated with a composition comprising, as an essential component, a polymer having a weight average molecular weight of not less than 20,000 which is obtained by reacting a polyvalent carboxylic acid, or anhydride or lower alkyl ester thereof with a polyhydroxyl compound having a weight average molecular weight of not less than 1,000 obtained by adding ethylene oxide and/or propylene oxide to a compound having 2 to 4 active hydrogen atoms.

14 Claims, 2 Drawing Sheets

INK JET RECORDING MEDIUM

BACKGROUND OF THE INVENTION

1. Field of the Invention

The present invention relates to a recording medium suitable for use in ink-jet recording and an ink-jet recording method making use of this medium.

2. Related Background Art

As recording media for ink-jet recording, there have hitherto been used recording paper as described in Japanese Patent Publication No. 3-26665, which comprises a base paper web and a coating layer provided on the base paper web and containing finely powdered silica and a water-soluble binder such as polyvinyl alcohol, glossy paper as described in Japanese Patent Publication No. 3-25352, which comprises a cast-coated paper web and a film formed on the cast-coated paper web and containing polyvinyl alcohol having a saponification degree of from 50 to 90 mole % and a crosslinking agent, and a recording sheet for OHP as described in Japanese Patent Publication No. 3-13993, which comprises a polyester film and a hydrophilic film provided on the polyester film and composed of a mixture of water-soluble polyvinyl alcohol, water-insoluble polyvinyl alcohol and a water-dispersed polyester.

With the improvement in performance of ink-jet recording apparatus, such as speeding up of recording and multi-coloring of images, recording media for ink-jet recording are also required to have improved properties. More specifically, they are required to satisfy simultaneously, for example, the following properties:

(1) having high ink absorptivity (absorbing capacity being great, and absorbing time being short);

(2) providing dots high in optical density and clear in periphery;

(3) providing dots having a substantially round shape and a smooth periphery;

(4) undergoing minimal changes in the properties even at varied temperatures and humidities and with no curling;

(5) undergoing no blocking; and (6) being able to stably store images thereon for a long period of time without deteriorating them.

These properties are often in a relation of trade-off. It has hence been impossible to satisfy them at the same time by the conventionally known techniques. For example, the exemplified recording media of the prior art have comparable performance in dot shape and blocking resistance, but are poor in ink absorptivity. Therefore, they cause image smearing and unevenness of color strength due to running-out of ink at areas high in image density, i.e., areas on which many ink droplets have been jetted. In addition, they cause color muddiness due to mixing of colors at boundaries between different colors, particularly, in the case of color printing.

With the progress of speeding up of recording, and increasing of image density and coloring of images, reduction in image quality due to defective ink fixing has become a serious problem.

A recording sheet described in Japanese Patent Publication No. 3-29596 and having an ink-receiving layer composed principally of polyvinyl pyrrolidone is relatively good in ink absorptivity at normal temperature and humidity, but is extremely slow in drying of ink at high temperature and humidity and hence tends to cause blocking. The sheet also has a drawback that its recording surface is low in mechanical strength and hence liable to flaw.

SUMMARY OF THE INVENTION

It is an object of the present invention to provide a recording medium which satisfies the above-described properties at the same time in a well-balanced relation, and an ink-jet recording method making use of this recording medium.

The above object can be achieved by the present invention described below.

In a first aspect of the present invention, there are thus provided a recording medium comprising a base material, the surface of which is coated with a composition comprising, as an essential component, a polymer (hereinafter called "Component A") having a weight average molecular weight of not less than 20,000 which is obtained by reacting a polyvalent carboxylic acid, or anhydride or lower alkyl ester thereof with a polyhydroxyl compound having a weight average molecular weight of not less than 1,000 obtained by adding ethylene oxide and/or propylene oxide to a compound having 2 to 4 active hydrogen atoms, and an ink-jet recording method comprising ejecting an ink on the recording medium described above from an orifice of a recording head in accordance with a recording signal.

In a second aspect of the present invention, there are also provided a recording medium comprising a base material, the surface of which is coated with a composition comprising, as an essential component, a polymer (Component A) having a weight average molecular weight of not less than 20,000 which is obtained by reacting a polyvalent carboxylic acid, or anhydride or lower alkyl ester thereof with a polyhydroxyl compound having a weight average molecular weight of not less than 1,000 obtained by adding ethylene oxide and/or propylene oxide to a compound having 2 to 4 active hydrogen atoms, and at least one polymer (hereinafter called "Component B") selected from polyvinyl acetate, polyvinyl alcohol, polyvinyl acetal and derivatives thereof, and an ink-jet recording method comprising ejecting an ink on the recording medium described above from an orifice of a recording head in accordance with a recording signal.

In a third aspect of the present invention, there are further provided a recording medium comprising a base material, the surface of which is coated with a composition comprising, as an essential component, a polymer (Component A) having a weight average molecular weight of not less than 20,000 which is obtained by reacting a polyvalent carboxylic acid, or anhydride or lower alkyl ester thereof with a polyhydroxyl compound having a weight average molecular weight of not less than 1,000 obtained by adding ethylene oxide and/or propylene oxide to a compound having 2 to 4 active hydrogen atoms, and at least one polymer (hereinafter called "Component C") selected from celluloses and derivatives thereof, and an ink-jet recording method comprising ejecting an ink on the recording medium described above from an orifice of a recording head in accordance with a recording signal.

In the recording medium according to the present invention, the proportion of Component A to Component B or Component C in the composition may be in a range of from 1:49 to 49:1, preferably, from 1:19 to 19:1 by weight, and the base material may be a paper web.

In the ink-jet recording method according to the present invention, which comprises ejecting an ink on the recording medium from an orifice of a recording head in accordance with a recording signal, a liquid medium component in the ink may be composed principally of water and a water-miscible glycol or glycol ether, the recording may be conducted with cyan, magenta, yellow and black inks, and the ink may be ejected by thermal energy.

DETAILED DESCRIPTION OF THE PREFERRED EMBODIMENTS

Figure 1A:
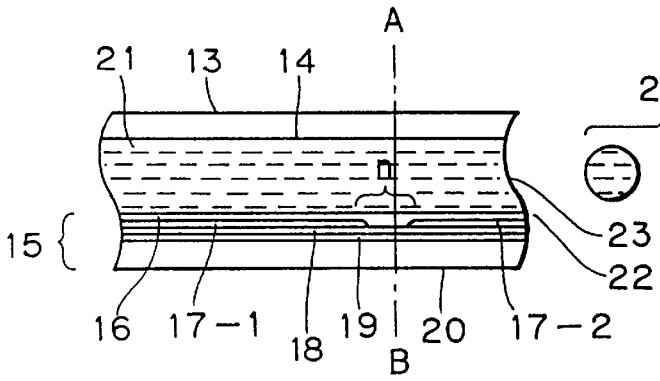
FIG. 1A is a longitudinal cross section of a head of an ink-jet recording apparatus suitable for use in an ink-jet recording method according to the present invention.
Figure 1B:
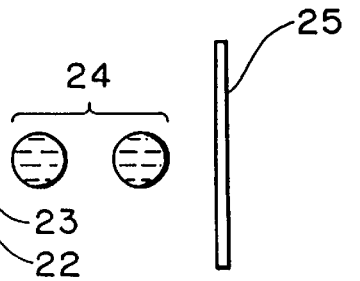
FIG. 1B is a longitudinal cross section of recording droplets ejected from the head to a recording medium.

The present inventors have carried out an extensive investigation with a view toward developing recording paper suitable for use in ink-jet recording and a transparent film for overhead projectors. As a result, it has been found that a recording medium coated with each of the above-described compositions is extremely good in ink absorptiveness, provides bright and sharp dots, is excellent in blocking resistance, undergoes little changes in performance even under varied environmental conditions of temperature and humidity and is stable to long-term storage, leading to completion of the present invention.

Namely, excellent performance in practical use has been realized by the composition according to the first aspect of the present invention.

Besides, excellent performance in practical use has been realized by the synergistic effect of Components A and B or C in the composition according to the second or third aspect of the present invention, by which their defects are offset while making the best use of the features of the respective components.

First Aspect of the Invention

The first aspect of the present invention will hereinafter be described in more detail by the following preferred embodiments.

Component A which is useful in the practice of the present invention and is a compound principally featuring the present invention is a polymer having a weight average molecular weight not less than 20,000, preferably, not more than 10,000,000, more preferably, not less than 30,000 but not more than 5,000,000 and which is obtained by reacting a polyvalent carboxylic acid, or an anhydride or a lower alkyl ester thereof with a polyhydroxyl compound having a weight average molecular weight not less than 1,000, preferably, not more than 1,000,000, more preferably, not less than 3,000 but not more than 500,000 which is obtained by adding ethylene oxide and/or propylene oxide to a compound having 2 to 4 active hydrogen atoms. Examples of the compound having 2 to 4 active hydrogen atoms may include ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine, cyclohexylamine, bisphenol A, glycerol, trimethylolpropane, pentaerythritol, monoethanolamine, diethanolamine, triethanolamine and isopropanolamine. In order to add ethylene oxide and/or propylene oxide to such a compound having 2 to 4 active hydrogen atoms, these compounds are reacted at 90 to 200° C. for 2 to 30 hours in the presence of a catalyst such as sodium hydroxide in accordance with a method known per se in the art. If the molecular weight of the thus-obtained polyhydroxyl compound is less than 1,000, the strength of a film to be formed becomes low. Such a compound is hence unfit for achieving the object of the present invention. A polyvalent carboxylic acid, or an anhydride or a lower alkyl ester thereof is then reacted with the resulted poly-hydroxyl compound, thereby forming a high-molecular weight compound having a molecular weight not less than 20,000. Specific examples of the polyvalent carboxylic acid may include malonic acid, maleic acid, succinic acid, fumaric acid, itaconic acid, phthalic acid, isophthalic acid, terephthalic acid, adipic acid, sebacic acid, dimer acid, pyromellitic acid, trimellitic acid. Examples of the lower alkyl ester thereof may include monomethyl, dimethyl, monoethyl, diethyl, monopropyl, dipropyl, monobutyl, dibutyl esters of the above-mentioned carboxylic acids. The polymer according to the present invention is obtained by conducting the dehydration or dealcoholization (ester exchange) reaction of such a polyhydroxyl compound and the polyvalent carboxylic acid, or anhydride or lower alkyl ester thereof for 30 minutes to 10 hours with heating at 80 to 250° C. under a reduced pressure of from 0.001 to 20 mmHg. If the molecular weight of the crosslinked high-molecular compound thus obtained is less than 20,000, the strength of a film to be formed becomes low, resulting in a recording medium insufficient in blocking resistance. This polymer will then be described in more detail by the following synthetic examples. However, the present invention is not limited to these synthetic examples only. In the following, "part(s)" and "%" are by weight unless particularly noted.

Synthetic Example 1

An autoclave was charged with 140 parts of glycerol and 20 parts of potassium hydroxide. While heating the contents to 130° C., 12,000 parts of ethylene oxide were gradually added thereto to react them. The weight average molecular weight of the resulting reaction product (intermediate) was calculated by determining its hydroxyl number and base number and was found to be about 8,000. Then, 2 parts of dimethyl terephthalate were added to 100 parts of this product. After the contents were heated to 125° C., methanol was removed under a reduced pressure of 1 mmHg. The weight average molecular weight of the thus-obtained polymer was determined by high speed liquid chromatography and was found to be about 150,000.

Synthetic Examples 2 to 14

Various polymers were synthesized in the same manner as in Example 1. These polymers are shown in the following Table 1.

TABLE 1

| Syn. Ex. No. | Starting substance (parts) | Alkylene oxide (parts) Et. oxide | Prop. oxide | Mol. wt. of poly-hydroxyl compd. (int.) | Cross-linker (parts/ 100 parts of int.) | Wt. avg. mol. wt. of polymer formed |
|---|---|---|---|---|---|---|
| 1 | Glycerol (140) | 12000 | — | 8000 | Dimethyl tere-phthalate (2) | 150000 |

TABLE 1-continued

| Syn. Ex. No. | Starting substance (parts) | Alkylene oxide (parts) Et. oxide | Prop. oxide | Mol. wt. of poly-hydroxyl compd. (int.) | Cross-linker (parts/ 100 parts of int.) | Wt. avg. mol. wt. of polymer formed |
|---|---|---|---|---|---|---|
| 2 | Di-ethylene glycol (110) | 16000 | — | 10000 | Dimethyl maleate (1.5) | 250000 |
| 3 | Trimethy-lol propane (120) | 8000 | — | 3500 | Succinic anhydride (1.0) | 40000 |
| 4 | Penta-erythri-tol (180) | 6500 | 1500 | 7000 | Monoethyl adipate (1.2) | 100000 |
| 5 | Bis-phenol A (230) | 13000 | 2000 | 9500 | Isophtha-lic acid (3.5) | 50000 |
| 6 | Propy-lene glycol (200) | 3000 | 8000 | 3000 | Trimelli-tic acid (4.5) | 350000 |
| 7 | Poly-ethylene glycol (MW 3000) (150) | 70000 | — | 45000 | Dibuthyl sebacate (3.0) | 650000 |
| 8 | Cyclo-hexyl-amine (100) | — | 25000 | 20000 | Pyromelli-tic acid (1.8) | 350000 |
| 9 | 1,4-Butane-diol (90) | 20000 | — | 15000 | Maleic anhydride (2.5) | 150000 |
| 10 | Tetra-ethylene glycol (180) | 12000 | — | 70000 | Dimethyl iso-phthalate (3.5) | 120000 |
| 11 | Tri-ethanol-amine (350) | 40000 | — | 120000 | Dimer acid (1.5) | 1500000 |
| 12 | Ethylene glycol (110) | 5500 | 2500 | 6000 | dimethyl tere-phthalate (5.5) | 220000 |
| 13 | Glycerol (150) | 8000 | 2000 | 9000 | dimethyl maleate (2.0) | 95000 |
| 14 | Tri-ethylene glycol (200) | 10000 | 5000 | 13000 | Dimethyl adipate (1.8) | 110000 |

In the first aspect of the present invention, a composition containing the above-described Component A is applied to the surface of a base material to obtain a recording medium having an ink-receiving layer on the surface of the base material. Various binders, fillers and additives may be used in combination with Component A in this composition within limits not impeding the achievement of the object of the present invention. Examples of the binders may include conventionally known starch, cationic starch, casein, gelatin, acrylic resins, maleic anhydride resins, melamine resins, urea resins, SBR latexes, sodium arginate, polyvinyl pyrrolidone. However, the binders are not limited thereto. Examples of the fillers may include silica, alumina, aluminum silicate, magnesium silicate, basic magnesium carbonate, talc, clay, hydrotalcite, calcium carbonate, titanium oxide, zinc oxide, plastic pigments such as polyethylene, polystyrene and polyacrylate. However, the fillers are not limited thereto. Specific examples of the additives may include various surfactants, dye-fixing agents (water-proofings), antifoaming agents, antioxidants, optical whitening agents, ultraviolet absorbents, dispersing agents, viscosity modifiers, pH adjustors, mildew-proofing agents and plasticizers. These additives may be optionally selected from the conventionally-known compounds as necessary for the end application intended.

As the base material constituting the recording medium of the present invention, may be used a paper web such as wood free paper, medium-quality paper, art paper, bond paper, recycled paper, baryta paper, cast-coated paper or corrugated fiber-board, a film or sheet of a plastic such as polyethylene terephthalate, diacetate, triacetate, cellophane, celluloid, polycarbonate, polyimide, polyvinyl chloride, polyvinylidene chloride or polyacrylate, a glass plate, or a fabric such as rayon, acrylic, silk or polyester. The base material is suitably selected from the above-mentioned materials according to various conditions such as the intended recording application of the resulting recording medium, the use of recorded images and the adhesiveness to a composition to be coated thereon.

Upon the preparation of the recording medium according to the first aspect of the present invention, the above-described composition is first of all dissolved or dispersed, together with other additives if necessary, in water, or an alcohol or another suitable organic solvent to prepare a coating fluid.

The resulting coating fluid is applied to the surface of the base material by, for example, a roll coater, blade coater, air knife coater, gate roll coater, bar coater, size pressing, spray coating, gravure coater or curtain coater method. Thereafter, the thus-coated base material is dried using, for example, a hot-air drying oven, heating drum or the like, thereby obtaining a recording medium according to the present invention. As needed, the resulting recording medium may be further subjected to supercalendering or the like so as to increase the smoothness or surface strength of the ink-receiving layer.

The coat weight of the ink-receiving layer is within a range of from 0.2 to 50 g/m$^2$, more preferably from 0.2 to 20 g/m$^2$ in total. If the coat weight is made small, a part of the base material may be exposed without coating. Any coat weights less than 0.2 g/m$^2$ have little effect in respect of brightening ability of coating compared with the case where no ink-receiving layer is provided. If the coat weight of the ink-receiving layer provided exceeds 50 g/m$^2$ on the other hand, dusting-off occurs in the coating layer. It is hence not preferable to provide the ink-receiving layer in any coat weight outside the above range. The coat weight may preferably be within a range of from 0.5 to 100 $\mu$m in terms of thickness.

When ink-jet recording is conducted on the recording medium described above, any known inks may be used with no problem. As recording agents, may be used water-soluble dyes represented by direct dyes, acid dyes, basic dyes, reactive dyes and food colors. They may be used without imposing a particular limitation so far as they are those used in the conventional ink-jet recording. Such water-soluble dyes have been used in a proportion of from about 0.1 to 20% by weight in the conventional inks. In the present invention, they may also be used in such a proportion.

A solvent suitable for use in water-based inks used in the present invention is water or a mixed solvent of water and a water-soluble organic solvent. Mixed solvents composed of water and a water-soluble organic solvent and containing, as the water-soluble organic solvent, a polyhydric alcohol having an effect of inhibiting the drying of the ink are particularly preferred.

A preferred method of conducting recording by applying the above-described ink to the recording medium is an ink-jet recording method. As such a method, any systems may be used so far as they can effectively eject an ink out of a nozzle to apply it to the recording medium as a target.

In particular, an ink-jet recording system described in Japanese Patent Application Laid-Open No. 54-59936, in which an ink undergoes a rapid volumetric change by an action of thermal energy applied to the ink, so that the ink is ejected through a nozzle by the working force generated by this change of state, may be used effectively.

An illustrative ink-jet recording apparatus suitable for use in recording making use of the recording medium according to the present invention will hereinafter be described. Examples of the construction of a head, which is a main component of such an apparatus, are illustrated in FIGS. 1A, 1B, 2 and 3.

A head 13 is composed of a glass, ceramic or plastic plate or the like having an ink-passing channel 14 and a heating head 15, which is used for thermal recording (the drawing shows a head to which, however, the invention is not limited), said heating head 15 being bonded to the plate. The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

An ink 21 comes up to an ejection orifice 22 (a minute opening) and forms a meniscus 23 due to a pressure P.

Figure 3:
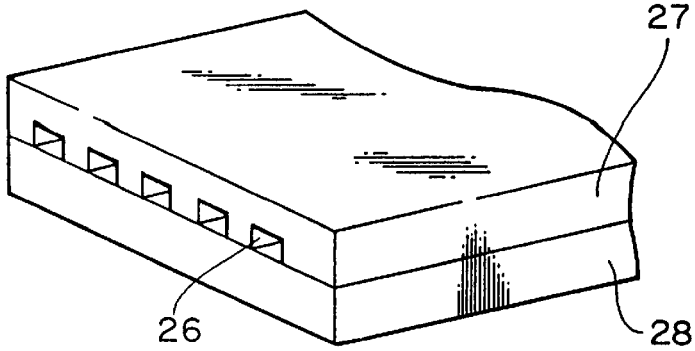
FIG. 3 is a perspective view of the appearance of a multi-head.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a recording medium 25 in the form of recording droplets 24, shown in FIG. 1B. FIG. 3 illustrates an appearance of a multi-head composed of an array of a number of heads as shown in FIG. 1A. The multi-head is formed by closely bonding a glass plate 27 having a number of channels 26 to a heating head 28 similar to that illustrated in FIG. 1A.

Figure 2:
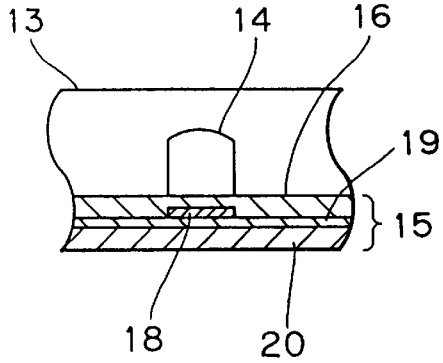
FIG. 2 is a transverse cross section of the head of the ink-jet recording apparatus suitable for use in the ink-jet recording method according to the present invention.

Incidentally, FIG. 1A is a cross-sectional view of the head 13 taken along the flow path of the ink, and FIG. 2 is a cross-sectional view taken along line A-B in FIG. 1A.

Figure 4:
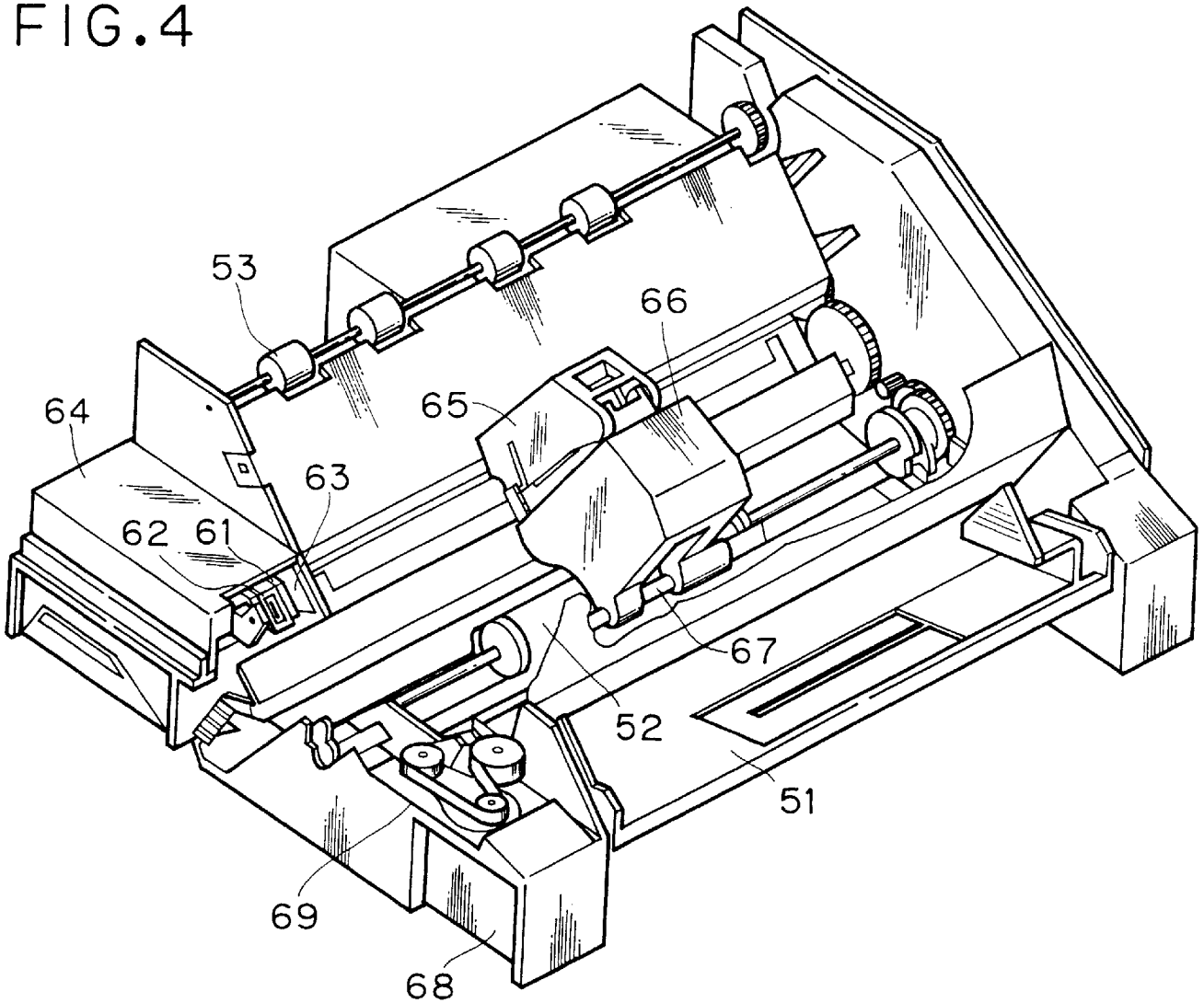
FIG. 4 is a perspective view of an illustrative ink-jet recording apparatus.

FIG. 4 illustrates an illustrative ink-jet recording apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a recording head operates, and in this embodiment, is held in such a form that it protrudes to the path through which the recording head is moved. Reference numeral 62 indicates a cap, which is provided at the home position adjacent to the blade 61, and is so constituted that it moves in the direction perpendicular to the direction in which the recording head is moved and comes into contact with the face of ejection openings to cap it. Reference numeral 63 denotes an ink-absorbing member provided adjoiningly to the blade 61 and, similar to the blade 61, held in such a form that it protrudes to the path through which the recording head is moved. The above-described blade 61, cap 62 and absorbing member 63 constitute a recovery portion 64 for the recording head, where the blade 61 and absorbing member 63 remove water, dust and/or the like from the face of the ink-ejecting openings.

Reference numeral 65 designates the recording head having an ejection-energy-generating means and serving to eject the ink onto a recording medium set in an opposing relation with the ejection opening face provided with ejection openings to conduct recording. Reference numeral 66 indicates a carriage on which the recording head 65 is mounted so that the recording head 65 can be moved. The carriage 66 is slidably interlocked with a guide rod 67 and is connected (not illustrated) to a belt 69 driven by a motor 68. Thus, the carriage 66 can be moved along the guide rod 67 and hence, the recording head 65 can be moved from a recording region to a region adjacent thereto.

Reference numerals 51 and 52 denote a paper feeding part from which the recording medium is inserted, and paper feed rollers driven by a motor (not illustrated), respectively. With such construction, the recording medium is fed to the position opposite to the ejection opening face of the recording head, and discharged from a paper discharge section provided with paper discharge rollers 53 with the progress of recording.

In the above constitution, the cap 62 in the head recovery portion 64 is receded from the path of movement of the recording head 65 when the recording head 65 is returned to its home position, for example, after completion of recording, and the blade 61 remains protruded to the path of movement. As a result, the ejection opening face of the recording head 65 is wiped. When the cap 62 comes into contact with the ejection opening face of the recording head 65 to cap it, the cap 62 is moved so as to protrude to the path of movement of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement.

The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

Second Aspect of the Invention

Component B which is another principal compound according to the present invention is selected from polyvinyl acetate, polyvinyl alcohol, polyvinyl acetal and derivatives thereof. Specific examples of polymers preferably used may include polyvinyl acetate, vinyl acetate-acrylic copolymers, vinyl acetate-styrene copolymers, ethylene-vinyl acetate copolymers, partially saponified polyvinyl acetate, polyvinyl alcohol (100% saponified product), polyvinyl alcohol (88% saponified product), acetylated polyvinyl alcohol, cationic polyvinyl alcohol, polyvinyl formal, polyvinyl acetal, polyvinyl butyral, etc. These polymers are widely marketed in various grades.

Upon the preparation of the recording medium according to the second aspect of the present invention, a composition comprising, as essential components, the above-described Components A and B is first of all dissolved or dispersed, together with other additives if necessary, in water, or an alcohol or another suitable organic solvent to prepare a coating fluid.

The weight ratio of Component A to Component B is preferably within a range of from 1:49 to 49:1, more preferably, from 1:19 to 19:1. The ratio is not limited thereto so far as the object and effects of the present invention can be achieved.

Since other features of the recording medium according to the second aspect of the present invention are identical with those of the recording medium of the first aspect, their descriptions will be omitted.

Third Aspect of the Invention

Component C which is another principal compound according to the present invention is selected from celluloses and derivatives thereof. Specific examples of polymers preferably used may include methyl cellulose, ethyl cellulose, carboxymethyl cellulose, sodium carboxymethyl cellulose, benzyl cellulose, cellulose acetate, carboxyethylmethyl cellulose, ethylhydroxyethyl cellulose, hydroxyethyl cellulose, hydroxypropyl cellulose, water-soluble hemicellulose, finely powdered celluloses, etc. These celluloses are widely marketed in various grades.

Upon the preparation of the recording medium according to the third aspect of the present invention, a composition comprising, as essential components, the above-described Components A and C is first of all dissolved or dispersed, together with other additives if necessary, in water, or an alcohol or another suitable organic solvent to prepare a coating fluid.

The weight ratio of Component A to Component C is preferably within a range of from 1:49 to 49:1, more preferably, from 1:19 to 19:1 in order to achieve the object of the present invention though it is not limited thereto.

Since other features of the recording medium according to the third aspect of the present invention are identical with those of the recording medium of the first aspect, their descriptions will be omitted.

The present invention will hereinafter be described in more detail by the following examples. In the following examples, "part(s)" and "%" are by weight unless otherwise noted.

(First Aspect)

EXAMPLE 1

Four parts of the polymer obtained in Synthetic Example 1 were added to 91 parts of water and 5 parts of isopropyl alcohol with stirring and mixing to dissolve the polymer therein. The thus-obtained coating solution was applied by means of a wire bar to one side of a wood free paper web ("Ginwa", product of Sanyo-Kokusaku Pulp Co., Ltd.) to give a dry coat thickness of 4 $\mu$m. The thus-coated paper web was then dried at 70° C. for 10 minutes and treated by a super calender, thereby obtaining a recording medium according to the first aspect of the present invention. Using inks having the following compositions, color recording was conducted on the recording medium under the following conditions by means of an ink-jet recording apparatus in which an ink is ejected by the bubbling phenomenon of the ink caused by thermal energy.

| Composition of ink (Formulation A): | |
|---|---|
| Dye | 3 parts |
| Diethylene glycol | 15 parts |
| Water | 82 parts |
| Dye: | |
| Y: C. I. Direct Yellow #86 | |
| M: C. I. Reactive Red #23 | |
| C: C. I. Acid Blue #9 | |
| Bk: C. I. Reactive Black #31 | |
| Recording conditions: | |
| Jetting frequency: | 3 kHz |
| Volume of one jetting droplet: | 30 pl |

-continued

| | |
|---|---|
| Recording density: | 400 DPI |
| Maximum application volume of a single color ink: | 7.4 nl/mm$^2$ |
| Maximum number of overlapping colors: | 3 colors |

With respect to the resulting color print samples, the following properties were evaluated.

Evaluation (1) Ink Absorptivity

Full dot recording was conducted with the three inks of yellow, cyan and magenta colors. After the resulting recorded image was left for 30 seconds at room temperature (20° C., RH: 65%), it was touched with a finger to determine whether the inks had become free from adhesion to the finger because they have been taken up into the ink-receiving layer. The ink absorptivity was ranked as A where the inks did not adhere, C where the inks adhered or B where it was in-between thereof.

(2) Blocking Resistance

Full dot recording was conducted with the three inks of yellow, cyan and magenta colors. After hot air (100° C., air speed: 1 m/sec) was then applied to the recorded surface for 10 seconds, the recorded image was put into "Clear Pocket" (polypropylene film holder produced by Lion Corporation) under a pressure of 40 g/cm$^2$ to determine whether the film can be peeled easily from the recording medium. The blocking resistance was ranked as A where the film could be easily peeled, C where the peeling required considerable force or B where it was in-between thereof.

(3) Image Density

Solid printing was conducted with the black (Bk) ink by means of the printer described above. The image density of the print obtained at this time was determined by means of a Macbeth densitometer RD-918.

(4) Storability of Recording Medium

After each recording medium was stored for 7 days in an environment of 35° C. and 90% RH and then for 1 day in an environment of 23° C. and 55% RH, recording was conducted on the recording medium in an environment of 23° C. and 55% RH by means of the printer described above to evaluate its storability.

The storability was evaluated in comparison with the recording medium before the storage and ranked as C where running out of ink, exudation and dot gain occurred, so that image quality was remarkably poor, A where no change was recognized or B where it was in-between thereof.

(5) Image Irregularity

With respect to a print obtained by solid printing by means of the printer described above, the image irregularity was evaluated and ranked as A where no unevenness of color strength was recognized, C where unevenness of color strength was visually recognized even when observing the print 50 cm away from the eyes or B where it was in-between thereof.

(6) Resolution

Each of recorded images was projected on a screen by an OHP to rank its resolution as A where the projected image was high in contrast, bright and easy to read, C where bleeding or the like occurred, so that two different colors bled at their boundary, or lines having a pitch width of 0.1 mm and a thickness of 0.3 mm can not be distinguished from each other or B where it was in-between thereof.

| Evaluation: | |
|---|---|
| Ink absorptivity: | A |
| Blocking resistance: | A |
| Image density: | 1.56 |
| Storability: | A |
| Image irregularity: | A |
| Resolution: | A |

EXAMPLE 2

Five parts of the polymer obtained in Synthetic Example 2, 1 part of finely powdered silica ("Finesil X37", product of Tokuyama Soda Co., Ltd.), 0.1 part of a surfactant ("CERAMO P-16", product of Dai-ich Kogyo Seiyaku Co., Ltd.) and 94 parts of water were thoroughly dispersed by means of a ball mill to prepare a coating dispersion. The thus-obtained coating dispersion was applied to one side of a polyethylene terephthalate film (product of Toray Industries, Inc.) having a thickness of 100 $\mu$m in such a manner that the thickness of a coating layer was 10 $\mu$m. The thus-coated film was dried at 60° C. for 30 minutes to produce a recording medium. Recording was conducted on the recording medium using the same recording apparatus as that used in Example 1.

With respect to the resulting print samples, the following properties were evaluated.

| Composition of ink (Formulation B): | |
|---|---|
| Dye | 3 parts |
| Diethylene glycol monomethyl ether | 25 parts |
| Urea | 3 part |
| N-Methylpyrrolidone | 10 parts |
| Water | 59 parts |

Dye

The same dyes as those used in Example 1 were used.

Evaluation

In addition to the properties evaluated in Example 1, resistance to curling and fingerprint-proofness that is the ability to resist marking fingerprints were tested.

(7) Resistance to Curling

The film printed was placed on an overhead project or (Model 4000) manufactured by Sumitomo 3M Limited to measure the height of upward warpage at its corners after 3 minutes by a JIS first class metal scale. The resistance to curling was ranked as A where the height was less than 5 mm, B where the height was from 5 mm to 10 mm or C where the height was more than 10 mm.

(8) Fingerprint-Proofness

The thumb of the right hand was pressed hard against the film printed, after which the film was projected by an OHP. The fingerprint-proofness was ranked as A where the fingerprint scarcely appeared, B where the fingerprint slightly appeared or C where the fingerprint clearly appeared.

| Evaluation results: | |
|---|---|
| Ink absorptivity: | A |
| Blocking resistance: | A |
| Image density: | 1.45 |

-continued

| Evaluation results: | |
|---|---|
| Storability: | A |
| Image irregularity: | A |
| Resolution: | A |
| Resistance to curling: | A |
| Fingerprint-proofness: | A |

EXAMPLES 3 TO 12 AND COMPARATIVE EXAMPLES 1 TO 3

Respective recording media were prepared in the same manner as in Example 1 or 2, and color recording was conducted thereon. As comparative examples, the same evaluation as described above was conducted as to commercially-available recording paper, transparent film for ink-jet recording and the like. The details of the recording media and the evaluation results are given in the following Tables 2 and 3, respectively. Incidentally, a ball mill was used upon the preparation of coating fluids as needed.

TABLE 2

| Ex. No. | Base material | Coating fluid (parts) | | Coat thickness (solid, $\mu$) | Formulation of ink |
|---|---|---|---|---|---|
| Ex. 3 | Art paper | Polymer of Syn. Ex. 4 | (3) | 7 | B |
| | | Water | (96) | | |
| Ex. 4 | Xerox 4024 paper | Polymer of Syn. Ex. 5 | (1) | 3 | A |
| | | Silica (Nipsil E-200A, product of Nippon Silica) | (1) | | |
| | | Polyvinyl-pyrrolidone (K-90, product of GAF) | (4) | | |
| | | Water | (84) | | |
| Ex. 5 | Recycled paper (EW-500, product of Canon Hanbai) | Polymer of Syn. Ex. 8 | (7) | 10 | A |
| | | Gelatin | (2) | | |
| | | Cationic resin (PAA-105, product of Nitto Boseki) | (1) | | |
| | | Water | (70) | | |
| Ex. 6 | Polycarbonate film (100$\mu$) | Polymer of Syn. Ex. 10 | (2) | 15 | B |
| | | Modified polyvinyl pyrrolidone (LUVISCOL VA-73, product of Mitsubishi petrochemical) | (4) | | |
| | | Water | (94) | | |
| Ex. 7 | Polyester film (75$\mu$) | Polymer of Syn. Ex. 12 | (3) | 8 | A |
| | | Water-soluble nylon (AQ-A-90, product of Toray) | (3) | | |
| | | Water | (94) | | |
| Ex. 8 | Cast-coated paper | Polymer of Syn. Ex. 13 | (9) | 12 | A |
| | | Sodium arginate | (1) | | |
| | | Talc | (20) | | |
| | | Water | (70) | | |

TABLE 2-continued

| Ex. No. | Base material | Coating fluid (parts) | Coat thickness (solid, μ) | Formulation of ink |
|---|---|---|---|---|
| Ex. 9 | Cotton fabric | Coating fluid of Ex. 7 | 4 | A |
| Ex. 10 | Glass plate | Coating fluid of Ex. 1 | 18 | B |
| Ex. 11 | Base paper for coated paper having a Stöckigt sizing degree of 20 seconds | Coating fluid of Ex. 2 | 2 | B |
| Ex. 12 | Triacetate film | Coating fluid of Ex. 5 | 10 | B |
| Comp. Ex. 1 | OHP film (BG-31, product of Folex) | — | — | B |
| Comp. Ex. 2 | OHP film (CG-3480, product of Sumitomo 3M) | — | — | B |
| Comp. Ex. 3 | Ink-jet paper (BJ Paper, product of Canon) | — | — | B |

| Composition of ink (Formulation C): | |
|---|---|
| Dye | 4 parts |
| Diethylene glycol | 15 parts |
| Water | 81 parts |
| Dye: | |
| Y: C. I. Direct Yellow #86 | |
| M: C. I. Acid Red #35 | |
| C: C. I. Direct Blue #199 | |
| Bk: C. I. Food Black #2 | |
| Recording conditions: | |
| Jetting frequency: | 4 kHz |
| Volume of one jetting droplet: | 30 pl |
| Recording density: | 400 DPI |
| Maximum application volume of a single color ink: | 7.4 nl/mm$^2$ |
| Maximum number of overlapping colors: | 3 colors |

With respect to the resulting color print samples, the following properties were evaluated.

Evaluation

Evaluation was conducted in the same manner as in Example 1.

TABLE 3

| | Example | | | | | | | | | | | | Comp. Ex. | | |
|---|---|---|---|---|---|---|---|---|---|---|---|---|---|---|---|
| | 1 | 2 | 3 | 4 | 5 | 6 | 7 | 8 | 9 | 10 | 11 | 12 | 1 | 2 | 3 |
| Absorptivity | A | A | A | A | A | A | A | A | A | A | A | A | B | B | B |
| Blocking resistance | A | A | B | A | A | B | A | A | A | A | A | A | B | C | A |
| Image density | 1.56 | 1.45 | 1.62 | 1.61 | 1.65 | 1.63 | 1.69 | 1.71 | 1.59 | 1.62 | 1.66 | 1.67 | 1.56 | 1.54 | 1.47 |
| Storability | A | A | A | A | A | A | A | A | A | A | A | A | A | B | A |
| Image Irregularity | A | A | A | A | A | A | A | A | A | A | A | A | B | B | A |
| Resolution | A | A | A | A | A | A | A | A | A | A | A | A | A | A | B |
| Resistance to curling | — | A | — | — | — | A | A | — | — | — | — | A | C | A | — |
| Fingerprint-proofness | — | A | — | — | — | A | A | — | — | — | — | A | B | C | — |

(Second Aspect)

EXAMPLE 13

Four parts of the polymer obtained in Synthetic Example 1 and 2 parts of polyvinyl butyral ("S-lec KW-10", product of Sekisui Chemical Co., Ltd.) were added to 90 parts of water and 5 parts of isopropyl alcohol with stirring and mixing to dissolve them therein. The thus-obtained coating solution was applied by means of a wire bar to one side of a wood free paper web ("Ginwa", product of Sanyo-Kokusaku Pulp Co., Ltd.) to give a dry coat thickness of 5 μm. The thus-coated paper web was then dried at 80° C. for 10 minutes and treated by a super calender, thereby obtaining a recording medium according to the second aspect of the present invention. Using inks having the following compositions, color recording was conducted on the recording medium under the following conditions by means of an ink-jet recording apparatus in which an ink is ejected by the bubbling phenomenon of the ink caused by thermal energy.

| Evaluation results: | |
|---|---|
| Ink absorptivity: | A |
| Blocking resistance: | A |
| Image density: | 1.88 |
| Storability: | A |
| Image irregularity: | A |
| Resolution: | A |

EXAMPLE 14

Three parts of the polymer obtained in Synthetic Example 2, 2 parts of polyvinyl alcohol ("C-205, product of Kuraray Co., Ltd.) and 0.2 part of a surfactant ("CERAMO P-16", product of Dai-ich Kogyo Seiyaku Co., Ltd.) were added to 95 parts of water to prepare a coating solution in the same manner as in Example 13. The thus-obtained coating solution was applied to one side of a polyethylene terephthalate film (product of Toray Industries, Inc.) having a thickness of 100 μm in such a manner that the thickness of a coating layer was 10 μm. The thus-coated film was dried at 60° C. for 30 minutes to produce a recording medium.

Recording was conducted on the recording medium using the same recording apparatus as that used in Example 13.

With respect to the resulting print samples, the following properties were evaluated.

| Composition of ink (Formulation D): | |
|---|---|
| Dye | 3 parts |
| Triethylene glycol monomethyl ether | 25 parts |
| Urea | 5 part |
| N-Methylpyrrolidone | 10 parts |
| Water | 57 parts |

Dye

The same dyes as those used in Example 13 were used.

Evaluation

Evaluation was conducted in the same manner as in Example 2.

| Evaluation results: | |
|---|---|
| Ink absorptivity: | A |
| Blocking resistance: | A |
| Image density: | 1.65 |
| Storability: | A |
| Image irregularity: | A |
| Resolution: | A |
| Resistance to curling: | A |
| Fingerprint-proofness: | A |

EXAMPLES 15 TO 24 AND COMPARATIVE EXAMPLES 4 TO 6

Respective recording media were prepared in the same manner as in Example 13 or 14, and color recording was conducted thereon. As comparative examples, the same evaluation as described above was conducted as to commercially-available recording paper, transparent film for ink-jet recording and the like. The details of the recording media and the evaluation results are given in the following Tables 4 and 5, respectively. Incidentally, a ball mill was used upon the preparation of coating fluids as needed.

TABLE 4

| Ex. No. | Base material | Coating fluid (parts) | | Coat thickness (solid, μ) | Formulation of ink |
|---|---|---|---|---|---|
| Ex. 15 | Baryta paper | Polymer of Syn. Ex. 4 | (3) | 8 | D |
| | | PVB-KW-10 (product of Sekisui) | (1) | | |
| | | Water | (96) | | |
| Ex. 16 | Xerox 4024 paper | Polymer of Syn. Ex. 5 | (1) | 3 | C |
| | | Silica (Nipsil E-200A, product of Nippon Silica) | (1) | | |
| | | Modified polyvinyl acetate (SMR-30L, product of Shin-Etsu Chemical) | (4) | | |
| | | Isopropyl alcohol | (50) | | |
| | | Water | (34) | | |
| Ex. 17 | Recycled paper (EW-500, product of Canon Hanbai) | Polymer of Syn. Ex. 8 | (7) | 10 | D |
| | | Acetylated polyvinyl alcohol (GOHSEFIMER, product of The Nippon Synthetic Chemical Industry) | (2) | | |
| | | Cationic resin (PAA-105, product of Nitto Boseki) | (1) | | |
| | | Isopropyl alcohol | (70) | | |
| | | Water | (70) | | |
| Ex. 18 | Polyester film (100 μ) | Polymer of Syn. Ex. 10 | (2) | 15 | C |
| | | Polyvinyl butyral ("S-lec KX-1", product of Sekisui Chemical) | (19) | | |
| | | Ethyl alcohol | (90) | | |

TABLE 4-continued

| Ex. No. | Base material | Coating fluid (parts) | | Coat thickness (solid, μ) | Formulation of ink |
|---|---|---|---|---|---|
| Ex. 19 | Polyester film (75 μ) | Polymer of Syn. Ex. 12 | (3) | 8 | D |
| | | Modified polyvinyl alcohol (KL-118, product of Kuraray) | (3) | | |
| | | Water | (94) | | |
| Ex. 20 | Cast-coated paper | Polymer of Syn. Ex. 14 | (9) | 12 | C |
| | | GOHSEFIMER Z-100 | (1) | | |
| | | Talc | (20) | | |
| | | Water | (70) | | |
| Ex. 21 | Cotton fabric | Coating fluid of Ex. 16 | | 4 | D |
| Ex. 22 | Glass plate | Coating fluid of Ex. 13 | | 20 | C |
| Ex. 23 | Base paper for coated paper having a Stöckigt sizing degree of 20 seconds | Coating fluid of Ex. 14 | | 2 | C |
| Ex. 24 | Triacetate film | Coating fluid of Ex. 17 | | 10 | C |
| Comp. Ex. 4 | OHP film (BG-31, product of Folex) | — | | — | C |
| Comp. Ex. 5 | OHP film (CG-3480, product of Sumitomo 3M) | — | | — | C |
| Comp. Ex. 6 | Ink-jet paper (BJ Paper, product of Canon) | — | | — | C |

TABLE 5

| | Example | | | | | | | | | | | | Comp. Ex. | | |
|---|---|---|---|---|---|---|---|---|---|---|---|---|---|---|---|
| | 13 | 14 | 15 | 16 | 17 | 18 | 19 | 20 | 21 | 22 | 23 | 24 | 4 | 5 | 6 |
| Absorptivity | A | A | A | A | A | A | A | A | A | A | A | A | B | B | B |
| Blocking resistance | A | A | B | A | A | B | A | A | A | A | A | A | B | C | A |
| Image density | 1.88 | 1.65 | 1.95 | 1.58 | 1.62 | 1.66 | 1.67 | 1.91 | 1.44 | 1.61 | 1.77 | 1.63 | 1.56 | 1.54 | 1.47 |
| Storability | A | A | A | A | A | A | A | A | A | A | A | A | A | B | A |
| Image Irregularity | A | A | A | A | A | A | A | A | A | A | A | A | B | B | A |
| Resolution | A | A | A | A | A | A | A | A | A | A | A | A | A | A | B |
| Resistance to curling | — | A | — | — | — | A | A | — | — | — | — | A | C | A | — |
| Fingerprint-proofness | — | A | — | — | — | A | A | — | — | — | — | A | B | C | — |

(Third Aspect)

EXAMPLE 25

Four parts of the polymer obtained in Synthetic Example 1 and 2 parts of hydroxyethyl cellulose ("AG-15", product of Fuji Chemical K.K) were added to 90 parts of water and 4 parts of isopropyl alcohol with stirring and mixing to dissolve them therein. The thus-obtained coating solution was applied by means of a wire bar to one side of a wood free paper web ("Ginwa", product of Sanyo-Kokusaku Pulp 25 Co., Ltd.) to give a dry coat thickness of 5 μm. The thus-coated paper web was then dried at 80° C. for 10 minutes and treated by a super calender, thereby obtaining a recording medium according to the third aspect of the present invention. Using inks having the following compositions, color recording was conducted on the recording medium under the following conditions by means of an ink-jet recording apparatus in which an ink is ejected by the bubbling phenomenon of the ink caused by thermal energy.

| Composition of ink (Formulation E): | |
|---|---|
| Dye | 4 parts |
| Diethylene glycol | 17 parts |
| Water | 79 parts |
| Dye: | |
| Y: C. I. Direct Yellow #86 | |
| M: C. I. Reactive Red #23 | |
| C: C. I. Direct Blue #199 | |
| Bk: C. I. Food Black #2 | |
| Recording conditions: | |
| Jetting frequency: | 4 kHz |
| Volume of one jetting droplet: | 30 pl |
| Recording density: | 400 DPI |
| Maximum application volume of a single color ink: | 7.4 nl/mm$^2$ |
| Maximum number of overlapping colors: | 3 colors |

With respect to the resulting color print samples, the following properties were evaluated.

Evaluation

Evaluation was conducted in the same manner as in Example 1.

| Evaluation results: | |
|---|---|
| Ink absorptivity: | A |
| Blocking resistance: | A |
| Image density: | 1.90 |
| Storability: | A |
| Image irregularity: | A |
| Resolution: | A |

EXAMPLE 26

Three parts of the polymer obtained in Synthetic Example 2, 2 parts of hydroxypropyl cellulose ("HPC-SL, product of Nippon Soda Co., Ltd.) and 0.2 part of a surfactant ("CERAMO P-16", product of Dai-ich Kogyo Seiyaku Co., Ltd.) were added to 95 parts of isopropyl alcohol to prepare a coating solution in the same manner as in Example 25. The thus-obtained coating solution was applied to one side of a polyethylene terephthalate film (product of Toray Industries, Inc.) having a thickness of 100 $\mu$m in such a manner that the thickness of a coating layer was 10 $\mu$m. The thus-coated film was dried at 60° C. for 30 minutes to produce a recording medium. Recording was conducted on the recording medium using the same recording apparatus as that used in Example 25. With respect to the resulting print samples, the following properties were evaluated.

| Composition of ink (Formulation F): | |
|---|---|
| Dye | 4 parts |
| Triethylene glycol monomethyl ether | 20 parts |
| Urea | 5 part |
| N-Methylpyrrolidone | 15 parts |
| Water | 56 parts |

Dye

The same dyes as those used in Example 25 were used.

Evaluation

Evaluation was conducted in the same manner as in Example 2.

| Evaluation results: | |
|---|---|
| Ink absorptivity: | A |
| Blocking resistance: | A |
| Image density: | 1.71 |
| Storability: | A |
| Image irregularity: | A |
| Resolution: | A |
| Resistance to curling: | A |
| Fingerprint-proofness: | A |

EXAMPLES 27 TO 36 and COMPARATIVE EXAMPLES 7 TO 9

Respective recording media were prepared in the same manner as in Example 25 or 26, and color recording was conducted thereon. As comparative examples, the same evaluation as described above was conducted as to commercially-available recording paper, transparent film for ink-jet recording and the like. The details of the recording media and the evaluation results are given in the following Tables 6 and 7, respectively. Incidentally, a ball mill was used upon the preparation of coating fluids as needed.

TABLE 6

| Ex. No. | Base material | Coating fluid (parts) | | Coat thickness (solid, $\mu$) | Formulation of ink |
|---|---|---|---|---|---|
| Ex. 27 | Baryta paper | Polymer of Syn. Ex. 4 | (4.5) | 6 | E |
| | | Cellulose powder (product of Asahi Chemical industry) | (0.5) | | |
| | | Water | (96) | | |
| Ex. 28 | Xerox 4024 paper | Polymer of Syn. Ex. 5 | (1) | 3 | F |
| | | Silica (Vitasil #1500, product of Taki Chemical) | (1) | | |
| | | Carboxymethyl cellulose (CMC-647, product of Sanyo-Kokusaku Pulp) | (4) | | |
| | | Water | (84) | | |
| Ex. 29 | Recycled paper (EW-500, product of Canon Hanbai) | Polymer of Syn. Ex. 7 | (7) | 10 | E |
| | | Methyl cellulose (METOLOSE 90SH-100, product of Shin-Etsu Chemical) | (2) | | |
| | | Cationic resin (PAA-105, product of Nitto Boseki) | (1) | | |
| | | Isopropyl alcohol | (10) | | |
| | | Water | (80) | | |
| Ex. 30 | Polyester film (100$\mu$) | Polymer of Syn. Ex. 9 | (0.5) | 15 | E |
| | | Hydroxypropyl cellulose (HPC-M, product of Nippon Soda) | (9) | | |

TABLE 6-continued

| Ex. No. | Base material | Coating fluid (parts) | | Coat thickness (solid, $\mu$) | Formulation of ink |
|---|---|---|---|---|---|
| | | Ethyl alcohol | (90.5) | | |
| Ex. 31 | Polyester film (75$\mu$) | Polymer of Syn. Ex. 12 | (3) | 8 | F |
| | | Hydroxypropyl cellulose (AH-15, product Fuji Chemical) | (3) | | |
| | | Water | (94) | | |
| Ex. 32 | Cast-coated paper | Polymer of Syn. Ex. 14 | (9) | 12 | F |
| | | Cellulose acetate (product of Kohjin) | (1) | | |
| | | Talc | (20) | | |
| | | Water | (70) | | |
| Ex. 33 | Cotton fabric | Coating fluid of Ex. 30 | | 4 | F |
| Ex. 34 | Glass plate | Coating fluid of Ex. 25 | | 18 | E |
| Ex. 35 | Base paper for coated paper having a Stöckigt sizing degree of 20 seconds | Coating fluid of Ex. 26 | | 2 | E |
| Ex. 36 | Triacetate film | Coating fluid of Ex. 31 | | 10 | E |
| Comp. Ex. 7 | OHP film (BG-31, product of Folex) | — | | — | E |
| Comp. Ex. 8 | OHP film (CG-3480, product of Sumitomo 3M) | — | | — | E |
| Comp. Ex. 9 | Ink-jet paper (BJ Paper, product of Canon) | — | | — | E |

TABLE 7

| | Example | | | | | | | | | | | | Comp. Ex. | | |
|---|---|---|---|---|---|---|---|---|---|---|---|---|---|---|---|
| | 25 | 26 | 27 | 28 | 29 | 30 | 31 | 32 | 33 | 34 | 35 | 36 | 7 | 8 | 9 |
| Absorptivity | A | A | A | A | A | A | A | A | A | A | A | A | B | B | B |
| Blocking resistance | A | A | B | A | A | B | A | A | A | A | A | A | B | C | A |
| Image density | 1.90 | 1.71 | 1.98 | 1.61 | 1.63 | 1.68 | 1.71 | 1.92 | 1.42 | 1.60 | 1.78 | 1.63 | 1.57 | 1.55 | 1.49 |
| Storability | A | A | A | A | A | A | A | A | A | A | A | A | A | B | A |
| Image Irregularity | A | A | A | A | A | A | A | A | A | A | A | A | B | B | A |
| Resolution | A | A | A | A | A | A | A | A | A | A | A | A | A | A | B |
| Resistance to curling | — | A | — | — | — | A | A | — | — | — | — | A | C | A | — |
| Fingerprint-proofness | — | A | — | — | — | A | A | — | — | — | — | A | B | C | — |

According to the present invention, as described above, there can be provided recording media having an ideal practical performance for ink-jet recording that ink absorptivity is high, bright dots can be provided, blocking resistance is excellent, stability to environmental changes of temperature and humidity is good, storability is superb, curling rarely occurs and resistance to fingerprints is high said good properties having hitherto been incompatible with each other.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording medium comprising a base material selected from the group consisting of paper web, film or sheet of plastic, glass plate and fabric, and an ink-receiving layer comprising a polymer, Component A, having a weight average molecular weight of not less than 20,000 and not more than 10,000,000 which is obtained by reacting a polyvalent carboxylic acid, or anhydride or lower alkyl ester thereof with a polyhydroxyl compound having a weight average molecular weight of not less than 1,000 and not more than 1,000,000 obtained by adding ethylene oxide and/or propylene oxide to a compound having 2 to 4 active hydrogen atoms, and Component B, which is polyvinyl acetate, the coat weight of the ink-receiving layer being within a range of from 0.2 to 50 g/m$^2$.

2. The recording medium according to claim 1, wherein the proportion by weight of Component A to Component B in the ink-receiving layer is in a range of from 1:49 to 49:1.

3. The recording medium according to claim 1, wherein the proportion by weight of Component A to Component B in the ink-receiving layer is in a range of from 1:19 to 19:1.

4. A recording medium comprising a base material selected from the group consisting of paper web, film or sheet of plastic, glass plate and fabric, and an ink-receiving layer comprising a polymer, Component A, having a weight average molecular weight of not less than 20,000 and not more than 10,000,000 which is obtained by reacting a polyvalent carboxylic acid, or anhydride or lower alkyl ester thereof with a polyhydroxyl compound having a weight average molecular weight of not less than 1,000 and not more than 1,000,000 obtained by adding ethylene oxide and/or propylene oxide to a compound having 2 to 4 active hydrogen atoms, and at least one polymer, Component C, comprising celluloses, the coat weight of the ink-receiving layer being within a range of from 0.2 to 50 g/m$^2$.

5. The recording medium according to claim 4, wherein the proportion by weight of Component A to Component C in the ink-receiving layer is in a range of from 1:49 to 49:1.

6. The recording medium according to claim 4, wherein the proportion by weight of Component A to Component C in the ink-receiving layer is in a range of from 1:19 to 19:1.

7. The recording medium according to claim 4, wherein Component C is selected from the group consisting of methyl cellulose, ethyl cellulose, carboxymethyl cellulose, sodium carboxymethyl cellulose, benzyl cellulose, cellulose acetate, carboxyethylmethyl cellulose, ethylhydroxyethyl cellulose, hydroxyethyl cellulose, hydroxypropyl cellulose, water-soluble hemicellulose, and finely powdered cellulose.

8. The recording medium according to claim 1 or 4, wherein the coat weight of the ink-receiving layer is in a range of from 0.2 to 20 g/m$^2$.

9. The recording medium according to claim 1 or 4, wherein the thickness of the ink-receiving layer is in the range of from 0.5 to 100 $\mu$m.

10. The recording medium according to claim 1 or 4, wherein Component A has a weight average molecular weight of not less than 30,000 and not more than 5,000,000.

11. The recording medium according to claim 1 or 4, wherein the hydroxyl compound has a weight average molecular weight of not less than 3,000 and not more than 500,000.

12. The recording medium according to claim 1 or 4, wherein the compound having 2 to 4 active hydrogen atoms is selected from the group consisting of ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine, cyclohexylamine, bisphenol A, glycerol, trimethylolpropane, pentaerythritol, monoethanolamine, diethanolamine, triethanolamine, and isopropanolamine.

13. The recording medium according to claim 1 or 4, wherein the polyvalent carboxylic acid is selected from the group consisting of malonic acid, maleic acid, succinic acid, fumaric acid, itaconic acid, phthalic acid, isophthalic acid, terephthalic acid, adipic acid, sebatic acid, dimer acid, pyromellitic acid, and trimellitic acid.

14. The recording medium according to claim 1 or 4, wherein the lower alkyl ester is selected from the group consisting of monomethyl ester, dimethyl ester, monoethyl ester, diethyl ester, monopropyl ester, dipropyl ester, monobutyl ester, and dibutyl ester.

* * * * *

UNITED STATES PATENT AND TRADEMARK OFFICE

CERTIFICATE OF CORRECTION

PATENT NO. : 6,200,676 B1
DATED : March 13, 2001
INVENTOR(S) : Miyuki Matsubara et al.

It is certified that error appears in the above-identified patent and that said Letters Patent is hereby corrected as shown below:

Column 4,
Line 9, “poly-hydroxyl” should read -- polyhydroxyl --.
Line 29, “then” should read -- now --.

Column 5,
Line 25, “Dibuthyl” should read -- Dibutyl --.

Column 6,
Line 12, “wood free” should read -- wood-free --.

Column 9,
Line 42, “wood free” should read -- wood-free --.

Column 11,
Line 47, “project or” should read -- projector --.

Column 13,
Line 58, “wood free” should read -- wood-free --.

Column 17,
Line 65, “wood” should read -- wood- --.

Column 22,
Line 65, “high” should read -- high, --.

Column 24,
Line 15, “sebatic” should read -- sebacic --.

Signed and Sealed this

Fourth Day of March, 2003

*Attest:*

*Attesting Officer*

JAMES E. ROGAN
*Director of the United States Patent and Trademark Office*